United States Patent [19]

Le Roux et al.

[11] 4,090,160

[45] May 16, 1978

[54] ELECTROMAGNETIC RELAY

[75] Inventors: Edouard Le Roux, Barentin; Christian Richard, Pavilly, both of France

[73] Assignee: Societe d'Appareillage Electrique Saparel S.A., Saint-Marcellin, France

[21] Appl. No.: 737,133

[22] Filed: Oct. 29, 1976

[30] Foreign Application Priority Data

| | | |
|---|---|---|
| Nov. 13, 1975 | France | 75 34654 |
| Aug. 6, 1976 | France | 76 24117 |
| Aug. 10, 1976 | France | 76 24357 |

[51] Int. Cl.[2] ..... H01A 9/00

[52] U.S. Cl. ..... 335/179; 335/229

[58] Field of Search ..... 335/277, 271, 278, 179, 335/79, 84, 85, 229, 230, 234

[56] References Cited

U.S. PATENT DOCUMENTS

| | | | |
|---|---|---|---|
| 3,060,355 | 10/1962 | Kruzic | 335/277 |
| 3,154,728 | 10/1964 | Bordenet | 335/85 X |
| 3,501,724 | 3/1970 | Westphal | 335/277 X |
| 3,559,129 | 1/1971 | Quichaud | 335/229 |

*Primary Examiner*—George Harris

*Attorney, Agent, or Firm*—Sughrue, Rothwell, Mion, Zinn and Macpeak

[57] ABSTRACT

An automatic relay having high sensitivity is of the type including a magnet, two magnetic parts, a magnetic shunt, a mobile armature co-operating with the two magnetic parts and a trip winding. The magnet and the magnetic shunt are inserted between two magnetic parts constituted by two U-shaped plates so as to constitute a flat assembly. The relay has application in any system requiring low control power.

23 Claims, 11 Drawing Figures

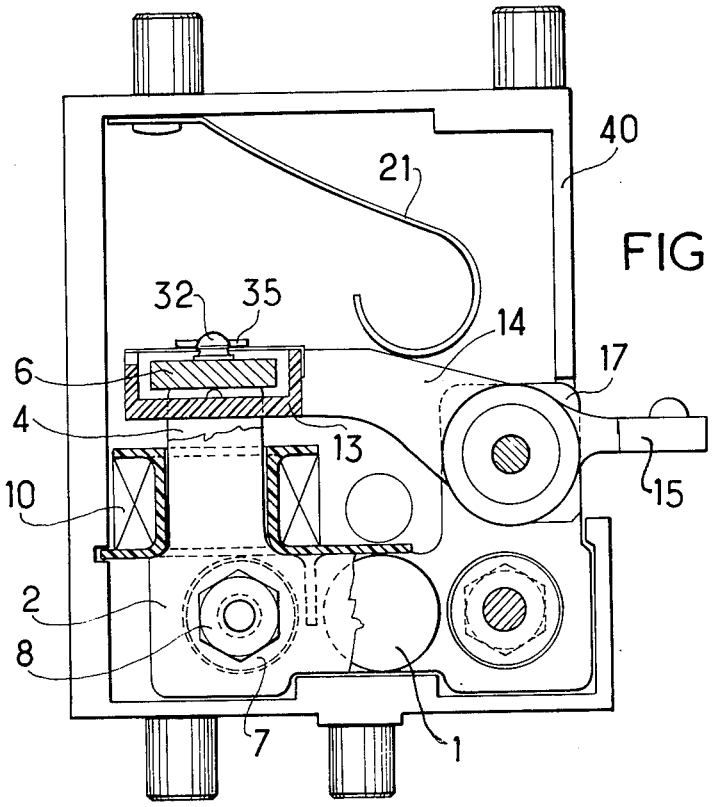
FIG. 4
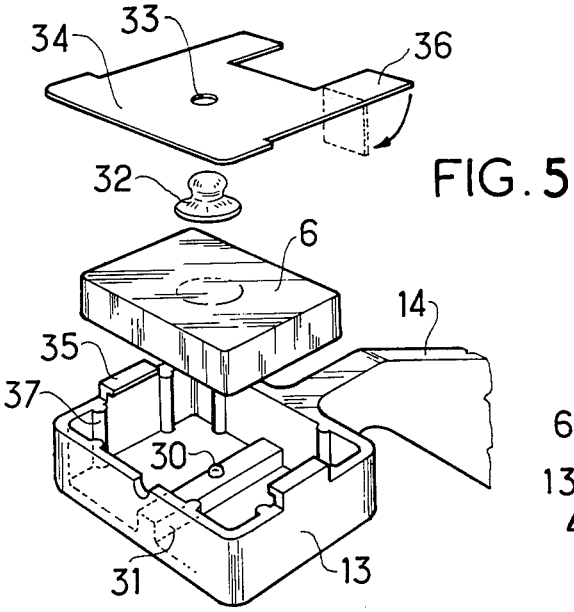
FIG. 5
FIG. 6
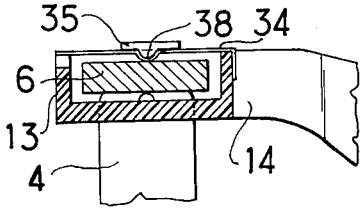

ELECTROMAGNETIC RELAY

BACKGROUND OF THE INVENTION

The present invention relates to an electromagnetic relay having high sensitivity, on armature release. In this type of relay, the mobile armature has a normal position in which it is magnetically held against two pole faces by a part of the flux of a permanent magnet; the remainder of this flux, which is generally the greater part being shunted by a magnetic shunt. The release of the mobile armature is obtained by reduction or cancellation of the flux circulating in the armature by means of an opposing flux generated by a control winding whose magnetic circuit includes the mobile armature and the magnetic shunt. The mechanical effect produced by the release of the armature is amplified by a trip spring which causes the opening of the armature.

SUMMARY OF THE INVENTION

The present invention provides a high sensitivity electromagnetic relay comprising a permanent magnet having optimised characteristics, two magnetic pole pieces, a magnetic shunt, a mobile armature co-operating with the two pole pieces and a trip winding wherein the two pole pieces are constituted by two U-shaped flat plates which sandwich between them the permanent magnet and the magnetic shunt to form a flat assembly, and wherein the mobile armature is normally applied to one arm of each plate.

The present invention also provides a device for fixing a relay or its housing on a support, enabling an improvement to the immunity against shocks and vibrations of an electromagnetic circuit-breaker, wherein the relay is fixed on its support by means of a plate made of resilient material so that the relay has no point of direct contact with the rigid support.

Preferred embodiments of the invention provide a relay having greater sensitivity and an armature holding force which is greater than that of known relays.

They also provide:

a relay having a magnet with a small volume which is therefore not very expensive and is protected against spurious magnetic fields;

a relay which is easy to manufacture, whose characteristics can readily be adjusted;

a relay whose structure is simplified with a view to reducing its manufacturing cost by obtaining magnetic parts with shapes not requiring a great amount of machining;

relays of different characteristics produced on a same production line;

a relay capable of being used in any physical orientation; and a relay whose mounting makes it insensitive to the shocks which its support undergoes, whether these shocks be caused by a control mechanism of a circuit-breaker or by any other device.

The characteristics and advantages of the invention will become apparent from the following description of relays embodying the invention, given by way of an example, with reference to the accompanying drawings.

BRIEF DESCRIPTION OF THE DRAWINGS

FIG. 4 is an elevation of the relay in a housing;

FIG. 5 is an exploded view of the armature and of an armature cage;

FIG. 6 is a partial elevation similar to FIG. 4 showing a modification to part of the relay;

DESCRIPTION OF PREFERRED EMBODIMENTS

Figure 1:
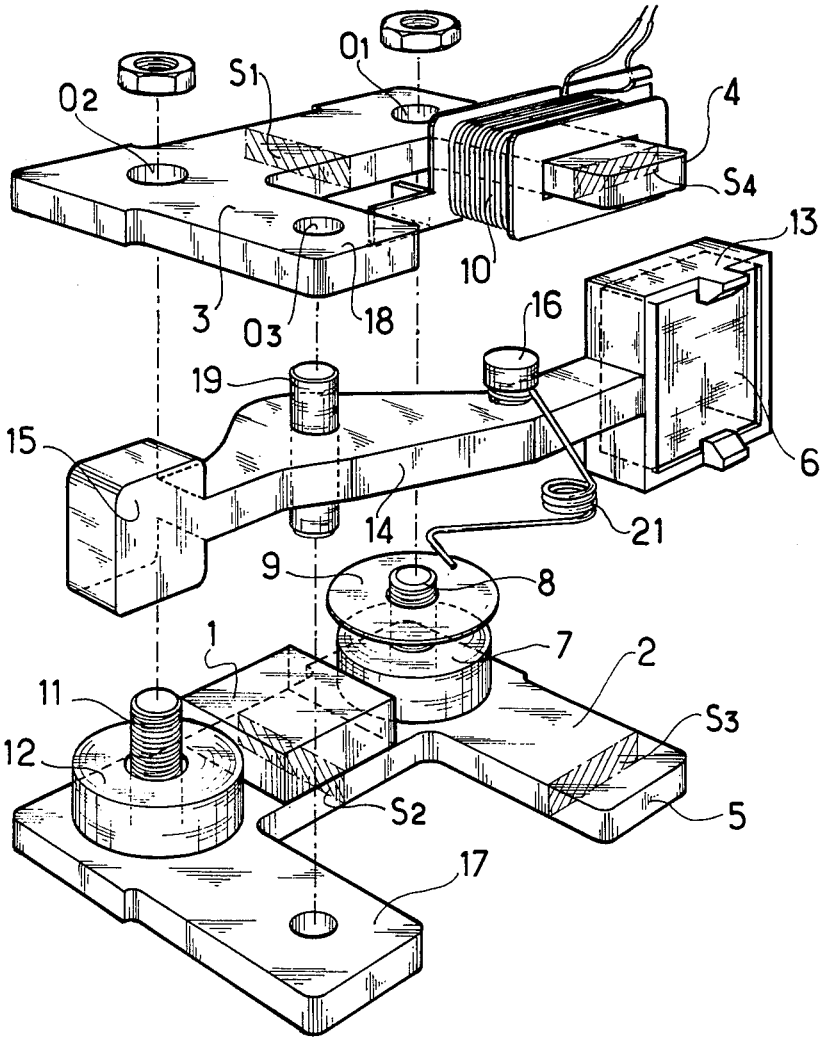
FIG. 1 is an exploded view of a relay forming one embodiment of the invention.
Figure 3:
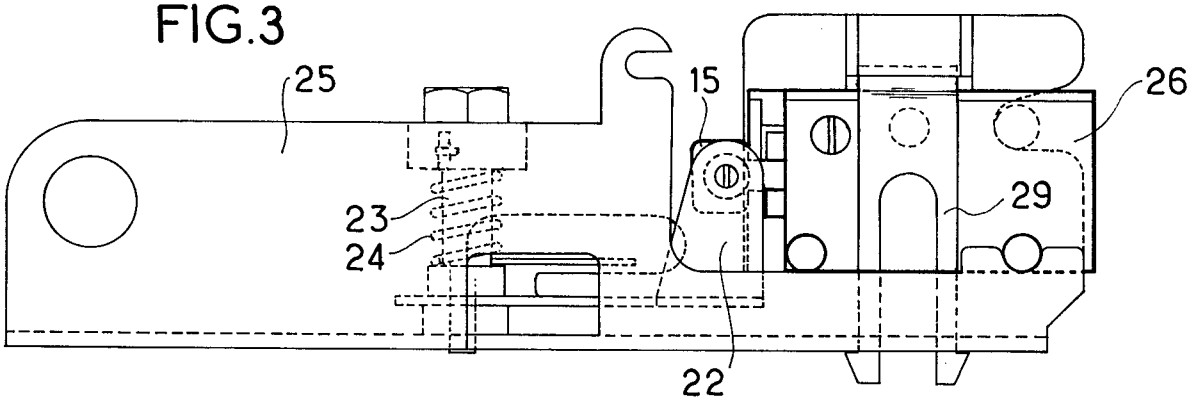
FIG. 3 is a top view of the relay of FIG. 2.
Figure 2:
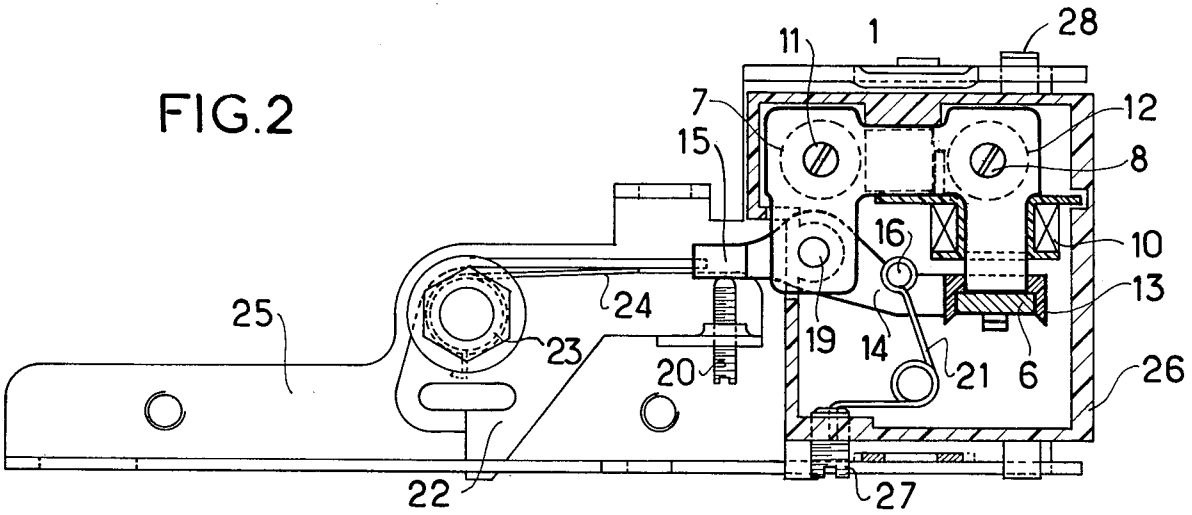
FIG. 2 is an elevation of the relay of FIG. 1 fixed on a support.

With reference to FIGS. 1, 2 and 3, the relay comprises a permanent magnet 1 inserted between two U-shaped magnetic plates 2 and 3 one arm of each forming two poles 4 and 5 co-operating with a mobile armature 6 and the other arm of each forming a pivot support of the armature carrier. The two plates 2 and 3 are connected together by a cylindrical magnetic shunt 7 made of high-permeability nickel-iron e.g. mumetal; this shunt is installed on a bolt 8 made of non-magnetic metal, e.g. brass, threaded through a hole 01 in the plates. A non-magnetic insert 9 consisting of a sheet of plastics material is inserted between the magnetic shunt 7 and one of the plates, for example the plate 3.

The two plates 2 and 3 made of high-permeability metal such as mumetal are assembled at the other angle of the U by means of a bolt 11 threaded through a second hole 02 in the plates and of a spacer 12 made of non-magnetic metal, e.g. brass. A trip winding 10 is wound around one of the pole pieces 4 or 5 and when it is fed with direct current or with one cycle of alternating current, its flux opposes that generated by the magnet 1 in the mobile armature.

The armature 6 is freely mounted in a cage 13 fixed at one end of an armature carrier 14 whose other end 15 constitutes a trip lug.

The central part of the armature carrier 14 is pivoted between the two arms 17, 18 of the U-shaped flanges which are opposite to the two pole pieces 4 and 5. It is pivoted on a pin 19 threaded through a third hole 03 in the plates 2 and 3. A spring 21 acting in the direction for resetting the mobile armature 6 is installed between a lug 16 of the armature carrier 14 and an adjusting screw 27 (FIG. 2).

A trip lever 22 is pivoted on a pin 23 and presses against the trip lug 15 of the armature carrier 14 by means of an adjustable stop screw 20. A return spring 24 mounted on the pin 23 provides the resilient bias of the trip lever 22 against the trip lug 15. When a trip current passes through the winding 10 the armature 6 is released from the pole pieces 4 and 5 and the armature carrier 14 rotates under the influence of the spring-loaded trip-lever 22 which also rotates and thereby triggers the trip mechanism of a circuit breaker.

The pin 23 is installed on a support 25 which also supports a housing 26 in which the relay is mounted. The housing 26 is fixed on the support 25 by means of studs 28 and a clip 29.

The three parts 13, 14, 15 of the armature carrier are preferably made of a single moulding of plastics material.

The relay is reset by bringing the lever 22 back to its position shown in FIG. 2; the armature carrier 14 is reset and at the end of its travel the armature 6 is automatically seated on the poles 4 and 5 under the effect of the spring 21.

The magnet 1 is held between the two webs of the two plates 2 and 3. The flux of the magnet can be adjusted by moving it perpendicularly to the plates. Sensitivity can also be adjusted by the screw 27 which bears on the resetting spring 21 and increases the holding force.

Taking X1 as the width of the pole pieces 4 and 5, X2 as the distance between the two plates, X3 as the thickness or diameter of the magnetic shunt, X4 as the thickness of an air shunt equivalent to the insert 9, it is observed that the relay obtained has a great armature attraction force, in the order of 300 g, with high sensitivity, in the order of 40 to 100$\mu$VA, when X1 has a value of 4.327 mm in the 4 to 5 mm range, X3 a value of 2.95 mm in the 2 to 6 mm range, X4 a value of 0.013 mm in the 0.01 to 0.02 mm range and while avoiding saturation of the magnetic parts; the search for the optimum value for X2 is tightly linked to the values of X1, X3 and X4.

The relay can operate with alternating current and with direct current.

The use of two U-shaped plates with a winding on one of the arms makes it possible to avoid saturation in an alternating current trip circuit. Indeed, only the cross-sections $S_1$ and $S_2$ of the plates 2 and 3 at the magnet are saturated and thus even out the magnet flux making the induction in the two arms 4 and 5 (cross-sections $S_3$, $S_4$), FIG. 1 independent from the tolerances in the magnet characteristics. Further, the flux due to the trip alternating current does not pass through the cross-sections $S_1$ and $S_2$ and thus their saturation does not cause an increase in power consumption. The position of the magnet between the plates makes it possible to protect it from the action of the outside magnetic or electric fields.

The proportions between the sections $S_1$-$S_2$, $S_3$-$S_4$, the volumes of the magnetic shunt 7 and the gap 9 are such that the induction of the magnet is twice as great in the section $S_1$-$S_2$ (in the 7000 to 8000 G range) as in the sections $S_3$-$S_4$ (below 4000G).

The trip spring is installed independently of the magnetic circuit of the relay. Relays of different sensitivity can be obtained in a relatively simple manner by modifying their relative characteristics.

Applications. The invention is applicable advantageously to trip relays for controlling the trip mechanism of a circuit-breaker, and in particular for a fault current overload switch. But it can also be used for various applications for lower-power controlling.

The U shape of the plates is a simple shape facilitating manufacture and making correction and grinding operations on magnetic surfaces easier.

The positioning of the saturated sections outside the magnetic circuit for armature release by the current in the winding does not bring about an increase in the power consumed.

The increase in the attraction force of the relay improves its resistance to shocks and vibrations.

In the embodiment shown in FIGS. 4 and 5, the relay has a permanent magnet 1 inserted between two U-shaped magnetic plates 2, two arms of each forming the poles 4 co-operating with a magnetic armature 6 and the other two arms or standards 17 forming a pivot support for the armature carrier 14. The two magnetic plates 2 are connected together by a magnetic shunt 7 installed on a bolt 8. A trip winding 10 is wound around one of the pole pieces 4 and when the winding is fed with current its flux opposes the flux generated in the mobile armature by the magnet 1. The armature 6 is installed in a cage 13 fixed to one end of the armature carrier 14 whose other end 15 constitutes a trip lug. A spring 21, acting in the resetting direction of the mobile armature 6, is fixed at one end to the top of a housing 40 and bears against the central part of the armature carrier 14.

The relay is reset by bringing the armature carrier 14 back into the position shown in FIG. 4. The armature 6 is reseated automatically on the poles 4 under the action of the spring 21 and of the attraction of the poles magnetized by the magnet 1.

The magnetic armature 6 rests on a bearing point or projection 30 placed at the centre of a bar 31 disposed at the bottom part of the cage 13. At its top part, the armature 6 is held by a resilient mushroom-shaped cushion 32, placed in a hole 33 of a backing plate 34. The backing plate 34 is fixed on the cage 13 by means of two catches 35 and by means of two flaps 36. The armature 6 is guided in the cage 13 by guide ribs 37.

In the embodiment shown in FIG. 6, the resilient cushion 32 is replaced by a boss 38 formed in the centre of the backing plate 34.

The dispositions described make it possible to fix an armature resiliently while allowing it to move slightly to position itself on the pole pieces so that the seating air-gap lies within the normal operating conditions of the relay. The cushion 32 is made of a resilient material such as for example an elastomer, urethane rubber, which is adhesive but stable after polymerization or drying or solidifying. It is injected in small quantities between the armature and the backing plate 34 to form a shock absorbing cushion. The cushion ensures a precise positioning connection which is sufficiently resilient between the armature and the backing plate not to transmit stresses other than those resulting from anticipated operation conditions.

The advantage of the configuration shown in FIGS. 4 and 5 makes it possible to provide a better operational adjustment, better stability over a number of manipulations and better resistance to shaking and vibration.

The industrial implementation is facilitated by the use of an automatic method for injecting a resilient material in controlled quantities.

FIG. 6 shows the embodiment in which the armature 6 is held in the cage 13 firstly on the bearing point 30 of the lower bar 31 and secondly by the boss 38 formed in the backing plate 34. In this disposition, the holding of the armature 6 is obtained by the elasticity of the backing plate 34.

Another advantage of this embodiment resides in the regularity of the relay which is not influenced by its orientation in space: vertical, horizontal or inclined.

Figure 7:
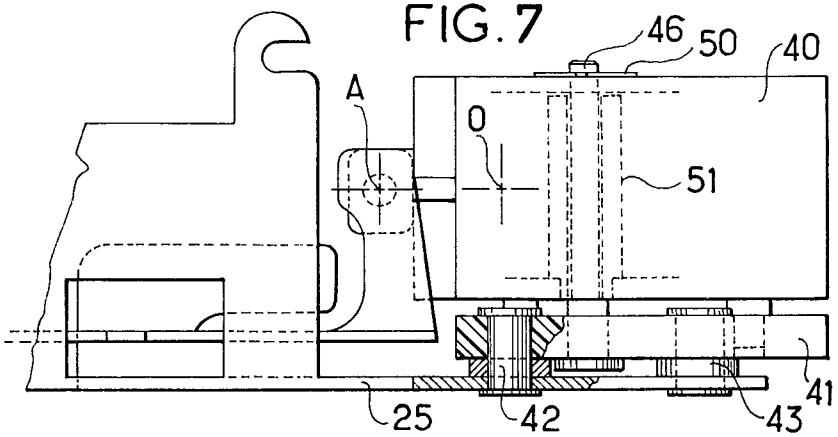
FIG. 7 is a top view similar to FIG. 3 of a relay fixed on its support.
Figure 8:
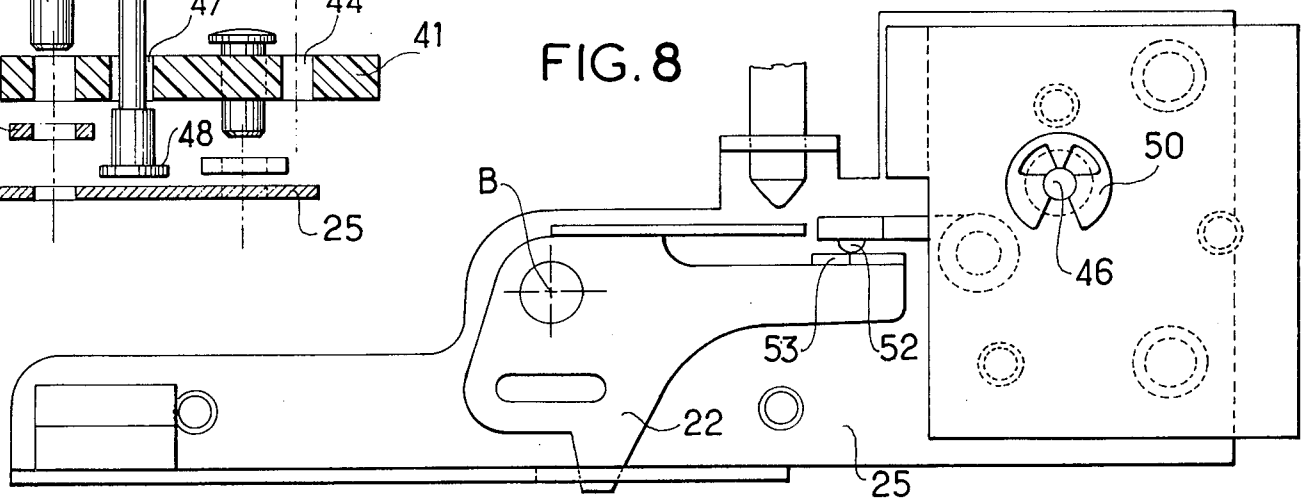
FIG. 8 is an elevation similar to FIG. 2 of the relay of FIG. 7.
Figure 9:
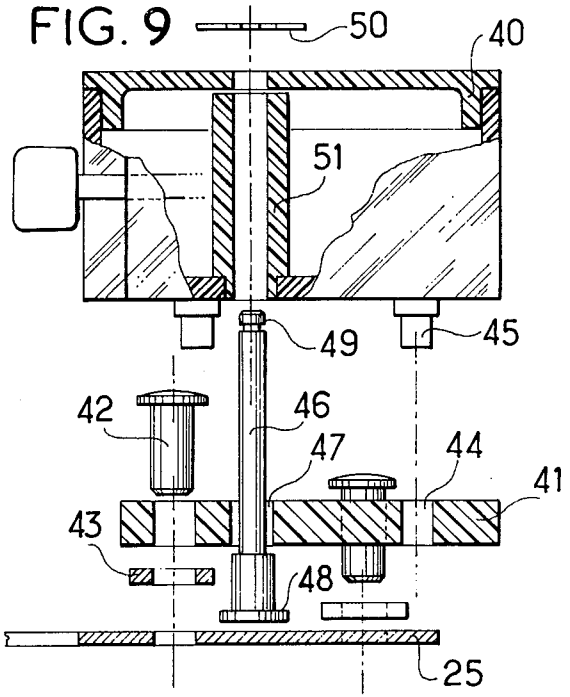
FIG. 9 is an exploded view of the assembly of the relay.

In the embodiment shown in FIGS. 7 to 9, the relay is enclosed in a housing 40 and is fixed on a mounting plate 25 by means of a resilient plate 41. The latter is fixed on the support 25 by means of three rivets 42, washers 43 being interposed to provide damping. The flexible plate 41 has three holes 44 in which three studs 45 on the base of the housing 40 are positioned. The housing 40 is fixed on the plate 41 by means of a pin 46 placed in a hole 47 in the resilient plate and held in this plate by a head 48. The pin 46 has a groove 49 in which is fixed a snap ring 50. The pin 46 is covered with a protective sheath 51 which passes through the housing 40 of the relay. The sheath 51 is stuck onto a wall of the relay and the pin extends slightly beyond the cover of the housing so as to enable the positioning of the snap ring 50 in the groove 49.

The plate 41 is made of a resilient material with Shore A hardness of less than 100, e.g. urethane rubber. The configuration shown enables the manufacturing of a relay for applications where they are subjected to extensive shaking and vibration. The relay is easy to position on its support by means of the three positioning studs 45 which provide a balanced suspension. No point of the housing is directly in contact with the rigid support 25, except for the point of application of the trip lug 15 of the armature carrier 14 on the contact part on the trip lug 15 of the trip lever 22, this application point being formed by a boss 52 on the trip lug 15 which presses against a plane seating 53 forming the contact part of the trip lever 22. But this contact point transmits practically no vibration to the relay; indeed, there is no variation in position of the lever arm 0A of the armature carrier as a function of any vibration or shaking, but only of the trip lever arm AB of the contact part; the ratio of the possible variations in the length of this lever arm gives negligible variations of the effort and hence contributes to the stability of the relay.

Figure 10:
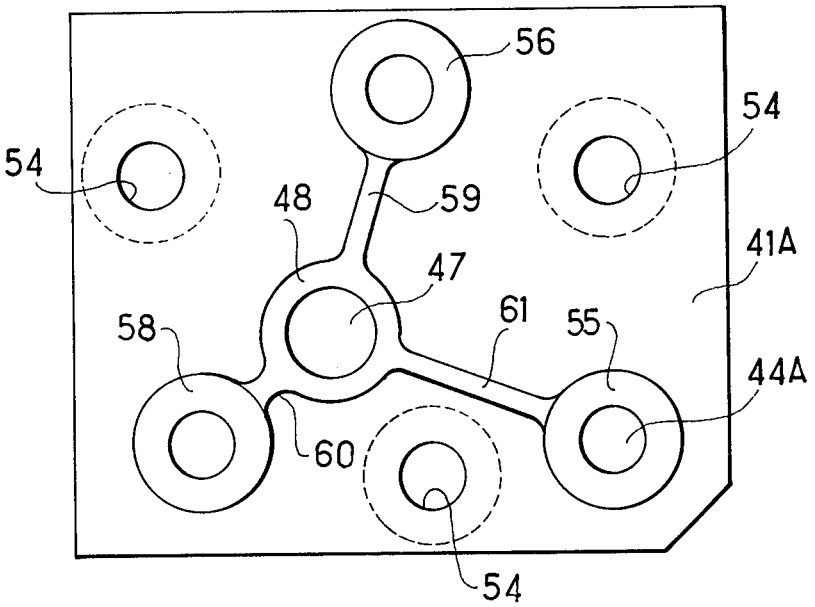
FIG. 10 is a top view of a resilient plate which is made of a harder material, but is thinner than the plate shown in FIGS. 7 and 9.
Figure 11:
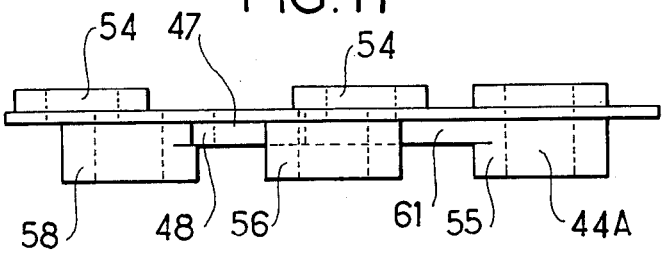
FIG. 11 is an elevation of the plate shown in FIG. 10.

The resilient plate 41A shown in FIGS. 10 and 11, being thinner, is made of a resilient material having greater hardness, which can range up to 85 in the Shore D scale made of a polyester elastomer for example, the resilience then being obtained by the cross-section and the distribution of the bearing points of the relay and of the support.

The plates 41A is fixed on the support by means of three rivets engaged in the holes 54 (the plate being shown in a top view in FIG. 10). It also has a hole 47, surrounded by a boss 48, enabling the passage of a pin fixed as previously to the housing by a snap ring and three holes 44A for inserting positioning studs, disposed round the hole 47 and whose bosses 55, 56, 58 are connected to the boss 48 by relative stiffener arms 59,60,61.

What we claim is:

1. In a high sensitivity electromagnetic relay comprising a permanent magnet having optimized characteristics, two magnetic pole pieces, a magnetic shunt, a mobile armature co-operating with the two pole pieces and a trip winding, the improvement wherein said permanent magnet and said magnetic shunt comprise flat plates, the two pole pieces are constituted by two superposed U-shaped flat, parallel plates which sandwich between them the flat plate permanent magnet and the magnetic shunt to form a stacked flat plate assembly, and wherein the mobile armature is normal to and spans across the ends of said pole pieces.

2. The relay according to claim 1, wherein the magnetic shunt is situated at an elbow of the U-shaped magnetic plates and forms a spacer between the two plates which are disposed parallel to each other, and said magnet is held tight between the central parts of the plates, and wherein the saturation of these central parts ensuring the regulation of the flux of the magnet and subsequently the independence of the induction in the ends of the pole pieces with respect to the tolerances on the characteristics of the magnet.

3. A relay according to claim 1, wherein a non-magnetic insert is disposed between the magnetic shunt and one of the plates.

4. The relay according to claim 1, further including a trip element with a return spring bearing on the armature carrier and biased in the opening direction of the mobile armature, said trip element being independent from the armature carrier.

5. The relay according to claim 1, including an adjustable return spring for closing the armature which comes into action at the end of the travel of the armature.

6. The relay according to claim 2, wherein the U-shaped plates each has one arm forming a pole piece for the armature and the two other arms of the plates form a pivot support for the armature carrier and said other two arms are assembled together with a non-magnetic spacer positioned therebetween.

7. A relay according to claim 1, wherein the armature carrier has a lug forming part of mechanical amplification lever.

8. The relay according to claim 1, wherein the armature carrier comprises three parts: an armature support cage, an articulation arm and a trip lug, which are of plastics material molded into a single piece.

9. The relay according to claim 1, wherein said magnet comprises a flat magnet of small dimensions inserted in a flat structure consisting of the two U-shaped plates disposed parallel to each other with a small gap between the two plates, and said plates are of mumetal.

10. A relay according to claim 9, wherein the width of a pole piece of a plate is in the 4 to 5 mm range, the thickness of the magnetic shunt is in the 2 to 6 mm range and the thickness of the insert is in the 0.005 to 0.02 mm range.

11. A relay according to claim 9, wherein the proportion between the sections of the magnetic circuit, the volumes of the magnetic shunt and the insert are such that the induction due to the magnet are twice as great in the sections of the central parts of the plates adjacent magnet as that in the sections of the pole piece parts.

12. The relay according to claim 1, wherein said a mobile armature is installed on an armature carrier which bears against two pole pieces of said magnetic circuit, and wherein the armature is held on the armature carrier by a resilient connection which positions the armature but allows it relative movement in relation to the pole parts.

13. A relay according to claim 12, wherein the armature is positioned in a cage and held between a lower central bearing point and an upper central bearing point enabling pivoting of the armature in the cage.

14. The relay according to claim 12, wherein the positioning of the armature on the armature carrier is obtained by means of a resilient cushion interposed between the carrier and the armature.

15. A relay according to claim 13, wherein the lower bearing point is on a bar integral with the cage and the upper bearing point is on a backing plate fixed on the cage.

16. A relay according to claim 14, wherein the cushion is formed by a mushroom shaped piece of resilient plastics material fixed in a hole in a holding plate.

17. The relay according to claim 12, wherein the cage has lateral guide ribs for centering the armature.

18. The relay according to claim 14, wherein the cushion is made of plastics material such as synthetic rubber.

19. A device for fixing a relay to a support to render the relay immune against shocks and vibrations, and wherein said relay is fixed to said support by means of a plate of resilient material such that the relay has no point of direct contact with the support, said relay being fixed onto the resilient plate by means of a pin, and means for fixing said pin to the plate without direct contact with said support.

20. A device according to claim 19, wherein said relay includes a housing and said resilient plate includes holes therein, and the housing of the relay has positioning studs which are spaced out and set in the holes of the resilient plate.

21. A device according to claim 20, wherein the pin is covered with a protective sheath passing through the relay housing.

22. A device according to claim 21, wherein the resilient plate is fixed on the support by fixing means such as rivets.

23. A device according to claim 22, wherein the resilient plate is made of a plastics material such as urethane rubber.

* * * * *